US005283966A

United States Patent [19]

Rader et al.

[11] Patent Number: 5,283,966

[45] Date of Patent: Feb. 8, 1994

[54] BADGE CONTAINING INTERCHANGEABLE FASTENERS

[75] Inventors: Norman P. Rader, Manchester, Mo.; Richard C. Haug, East Moriches; Peter C. Schellack, Huntington, both of N.Y.

[73] Assignee: MetalMasters By Rader Corporation, St. Louis, Mo.

[21] Appl. No.: 877,986

[22] Filed: May 4, 1992

[51] Int. Cl.[5] ..... A44C 3/00

[52] U.S. Cl. ..... 40/1.5; 63/20

[58] Field of Search ..... 40/1, 1.5, 1.6; 63/20; 24/3 L, 575, 704.1; 224/151, 183, 269, 271, 272

[56] References Cited

U.S. PATENT DOCUMENTS

| | | | |
|---|---|---|---|
| 1,917,325 | 7/1933 | Placco | 63/20 |
| 2,144,375 | 1/1939 | Huppert | 63/20 |
| 2,693,654 | 11/1954 | Clark | 63/20 |
| 3,139,690 | 7/1964 | Hait | 40/1.5 |
| 3,520,033 | 7/1970 | Usuda | 24/575 |
| 4,961,275 | 10/1990 | Klein | 40/1.6 X |
| 5,044,175 | 9/1991 | Razza | 63/20 X |
| 5,067,265 | 11/1991 | Harms | 40/1.5 |
| 5,117,538 | 6/1992 | Henry | 40/1.5 X |

FOREIGN PATENT DOCUMENTS

| | | | |
|---|---|---|---|
| 135430 | 11/1919 | United Kingdom | 40/1.6 |

*Primary Examiner*—James R. Brittain
*Assistant Examiner*—J. Bonifanti
*Attorney, Agent, or Firm*—Kalish & Gilster

[57] ABSTRACT

A badge included a badge plate and multiple and interchangeable means of fastening the badge to clothing or other items that are releasably attached, allowing the means of fastening to be interchanged. The means of fastening the badge includes a clip, a pair of military style pins, an alligator clip, a horizontal pin or a magnet.

9 Claims, 2 Drawing Sheets

FIG. 1
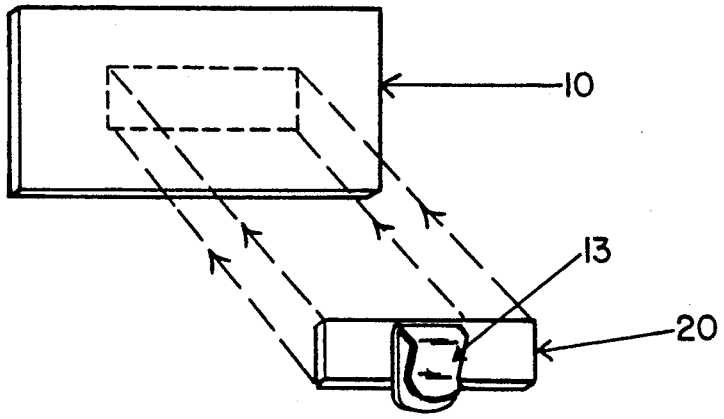
FIG. 2
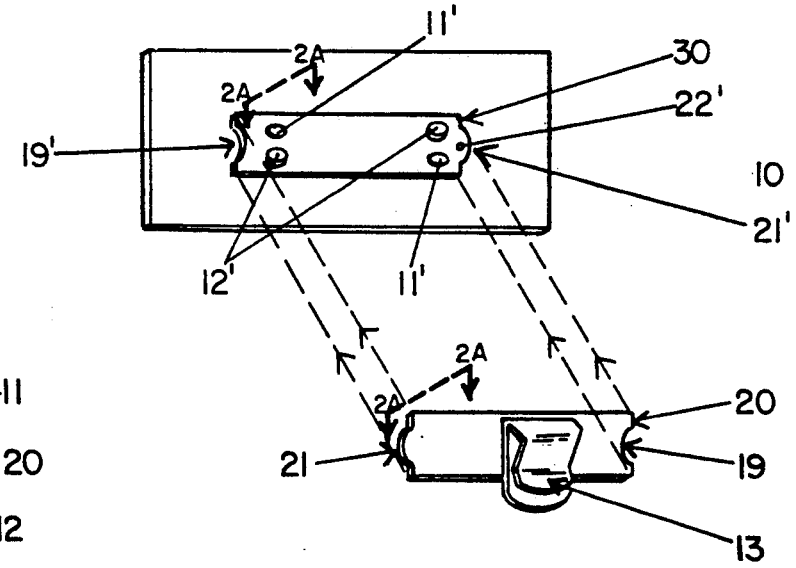
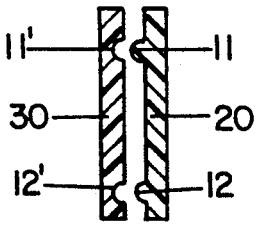
FIG.2A
FIG. 3
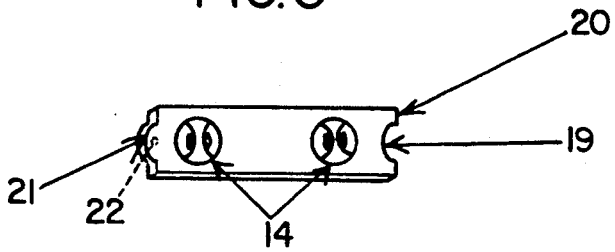

BADGE CONTAINING INTERCHANGEABLE FASTENERS

FIELD OF THE INVENTION

The present invention relates to a badge having a front plate and multiple interchangeable means for fastening the back of the badge onto clothing or other objects. The back of the badge plate and the fastening means are attached by releasable assembly means, allowing the multiple means of fastening onto clothing to be interchangeable.

BACKGROUND OF THE INVENTION

An identification badge that is fastened to clothing is disclosed in U.S. Pat. No. 3,810,321. The backup plate of the disclosed badge has a horizontal and a vertical slot, allowing the mounting of a horizontal pin, or, alternatively, a vertical alligator clip. The backup plate of this invention is permanently secured to the badge with cement. This invention allows the type of badge fastener to be varied while minimizing the stocking of parts. U.S. Pat. No. 3,810,321 fails to disclose the present invention allowing the interchangeability of fasteners.

U.S. Pat. No. 3,054,201 discloses an identification badge with a detachable clip. This allows the wearer to remove the clip and store the badge in his wallet until needed again. U.S. Pat. No. 3,054,201 fails to disclose the multiple, interchangeable fasteners of the present invention.

U.S. Pat. No. 4,0908,014 discloses an identification badge with multiple and interchangeable cards held in place by a transparent folder with clips. Different fastening means, such as a pin, alligator clip and clip, are disclosed which are each permanently mounted on the back of the badge. No interchangeable fastening means are disclosed.

None of the above references disclose the present badge device with multiple and interchangeable fastening means.

SUMMARY OF THE INVENTION

The present invention relates to a badge including a badge plate and multiple interchangeable means for fastening the badge plate to clothing or other objects, wherein the rear portion of the badge plate attaches to the means for fastening by releasable means.

BRIEF DESCRIPTION OF THE DRAWINGS

FIG. 1 is a rear perspective view of an embodiment of the invention utilizing a clip type means of fastening to clothing.

FIG. 2 is a rear perspective view of a preferred embodiment of the invention utilizing a clip type means of fastening to clothing.

FIG. 2A is a vertical sectional view taken on lines 2A—2A of FIG. 2, with panels 20, 30 in close proximity;

FIG. 3 is a rear perspective view of a preferred fastening means of the invention mounted on a panel, wherein the means is a military style pin.

DETAILED DESCRIPTION OF THE INVENTION

Figure 4:
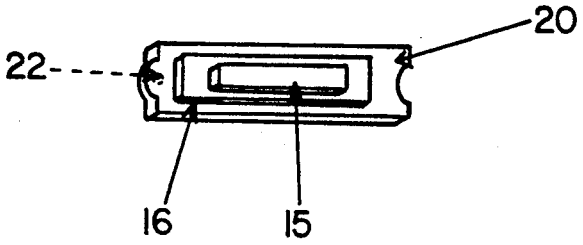
FIG. 4 is a rear perspective view of a preferred fastening means of the invention mounted on a panel, wherein the means is a magnet.

As shown in FIG. 1, the badge plate 10 of the present invention attaches releasably to a first panel 20 on which the means for fastening to clothing or other objects is mounted. The means for fastening the badge plate to a wearer illustrated in this figure is a clip 13, which, as shown, is connected to the rear surface of first panel 20;. The releasable assembly means for attaching 20 to the badge plate 10 is any acceptable fastening means that allows the secure attachment of the badge plate to the first panel 20 while enabling this element to be easily removed and reattached repeatedly. Examples of releasable assembly means include contact adhesives, snaps, magnets, VELCRO brand of synthetic material fasteners of the type which adhere when pressed together, DUAL LOCK brand of reclosable adhesive-backed flexible fasteners consisting of continuous plastic strips with fields of mushroom-shaped plastic heads which tightly interlock when pressed together, tongue and groove fasteners, channel assemblies, bayonet type assemblies and a combination of raised and recessed portions that engage and snap together as shown and described hereafter. The preferred releasable assembly means is a pair of matched panels namely first panel 20 and second panel 30. As shown in FIG. 2 first panel 20 which contains fastening means 13, is releasably attached to second panel 30 which is positioned on the rear surface of badge plate 10. Thus, first panel 20 is actually a part of the releasable assembly means, as well as being part of the means for fastening the badge plate to a wearer.

It is understood that the front surface (not shown) of badge plate 10 will typically identify the person wearing the badge by, for example, containing that person's name. Second panel 30 is fastened to badge plate 10 rear surface in any conventional manner as for example by a transfer adhesive such as transfer tape, a roll of transfer adhesive or adhesive cement in liquid form, chemical bonding such as solvent welding, ultrasonic welding and controlled heating. First panel 20 is provided on the front surface thereof with raised portions 11 and recessed portions 12 (FIG. 2A) (not shown). Second panel 30 is provided on the rear surface thereof with recessed portions 11' and raised portions 12'. Panels 20 and 30 are releasably attached and secured to each other by engaging matched and correspondingly positioned recessed portions 11 and 11' with raised portions 12 and 12'. Panel 20 is further provided with concave end 19 and convex end 21. Panel 30 is also provided with concave end 19' and convex end 21'. Thus to assemble the badge plate 10, first panel 20 is engaged in over lapping (substantially superimposed) relationship with second panel 30 by aligning matched, raised and recessed portions 11 and 11' respectively and matched recessed and raised portions 12 and 12' , respectively. The panels are then pressed together, securing one panel to the other. Furthermore, first panel 20 concave end 19 is positioned adjacent to second panel convex end 21'. This enables a wearer to easily release and disassemble the panels by merely inserting a finger nail in the space (not shown)

which necessarily remains between convex end 21 of first panel 20 and the rear surface of badge 10 to disengage the corresponding recessed and raised portions of panels 20 and 30.

Figure 5:
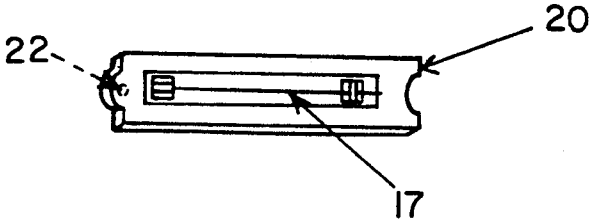
FIG. 5 is a rear perspective view of a preferred fastening means of the invention mounted on a panel, wherein the means is a horizontal pin.
Figure 6:
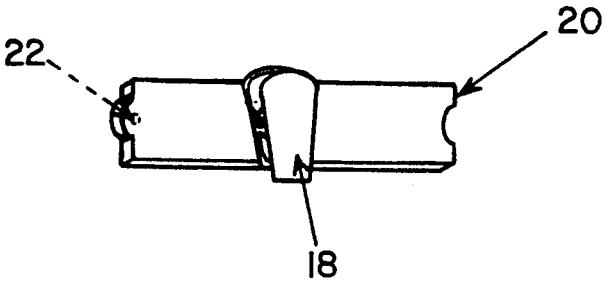
FIG. 6 is a rear perspective view of a preferred fastening means of the invention mounted on a panel, wherein the means is an alligator clip.

The means for fastening badge 10 to clothing or other objects, such as walls, cars or signs is any means that will securely fasten the badge to the clothing or other object. A rear perspective of examples of different means for fastening which can be mounted on the first panel are shown in FIG. 3, FIG. 4, FIG. 5 and FIG. 6. The first panel 20 of FIG. 2 has a clip 13; the first panel 20 of FIG. 3 has a pair of conventional military style (pinch release) pins 14; the first panel 20 of FIG. 4 has a magnet 15 in conjunction with a metal plate 16 attached permanently to first panel 20; the first panel 20 of FIG. 5 a horizontal pin 17; and the first panel 20 of FIG. 6 has an alligator clip 18. Thus, any of the above-described panels 20 may replace any of the others shown and described, the only differences between them being the particular fasteners (13, 14, 15, 17, 18) attached thereto.

In order to ensure that clip 13 and alligator clip 18 are properly oriented when a corresponding, attached first panel 20 is secured to a second panel 30 on badge plate/10, orientation protrusions 22 (phantom FIG. 3), and 22' (FIG. 2) are located on both facing both surfaces of first and second panel 30 on the respective panel 20 convex ends 21, 21' thereof. These protrusions serve to prevent the convex ends of second panel 30 and first panel 20 from overlapping and being pressed together when the badge of this invention is assembled. Thus, clips 13 and 18 will always be oriented for proper fastening to clothing, i.e., not upside down, and disassembly is facilitated by inserting a finger nail in the space which remains between the rear surface of badge 10 and the front surface of end 21 of panel 20; as herein described.

The preferred embodiment of the invention is shown in FIGS. 2, 3, 4, 5 and 6, wherein a badge plate 10 is provided with and fastened to second panel 30. If badge plate 10 is a plastic material, first panel 20 may be fastened thereto by chemical bonding as herein described. Alternatively badge plate 10 may be metallic wherein second panel 30 would be fastened by a transfer adhesive likewise described herein. The preferred embodiment is further provided with a combination of one or more means for fastening badge plate 10 to a wearer which includes a clip 13, a pair of military style pins 14, a magnet fastening means 15, a pin 17, and an alligator clip 18 mounted on a first panel 20. The panels 20 and 30 have corresponding aligned raised and, recessed portions and concave and convex end portions. This particular combination permits releasable assembly of first panels 20 having different badge fastening means. The badge plate and the fastening means can also be permanently mounted on the matching panels with glue, cement, brads or any other suitable mechanical device that securely and permanently attaches the panels.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A badge system for attaching a badge to clothing and other objects, comprising:

(a) a front badge plate having front and rear surfaces, the front surface for bearing identifying information and the rear surface being adapted for selectively removable connection to one of a plurality of interchangeable first panels;

(b) a plurality of interchangeable first panels each having a front surface and a rear surface, the front surface of each of the interchangeable first panels being adapted for selectively removable connection to the rear surface of the front badge plate and the rear surface of each of the interchangeable first panels providing a site for mounting any of a number of types of fasteners for fastening the badge to clothing and other objects, and for permitting the user to readily transfer the front badge plate from one article of clothing or other object to another;

(c) a fastener mounted on the rear surface of each of the first panels, the fastener mounted on the rear surface of any one of the interchangeable first panels not necessarily being of the same type as any other fastener mounted on any other one of the plurality of interchangeable first panels;

whereby each of the interchangeable first panels may be attached to the front badge plate and selectively removed therefrom in order to replace it with another of the interchangeable first panels having a different fastener attached thereto.

2. The badge system of claim 1 and further comprising a releasable assembly means for selectively releasably attaching the front badge plate at the rear surface thereof to one of the plurality of interchangeable first panels, the releasable assembly means being selected from the group consisting of contact adhesives, snaps, magnets, loop and hook fabric layer fasteners, releasable adhesive backed flexible fasteners, tongue and groove fasteners, and channel assemblies and a combination of corresponding releasably engagable raised and recessed portions which are formed on the front surface of the first panel and the rear surface of the front badge plate.

3. The badge system of claim 2 wherein the fastener is selected from the group consisting of a clip, a pair of military style pins, a magnet in conjunction with a metal plate, a horizontal pin, an alligator clip and a contact adhesive.

4. The badge system of claim 3 wherein the releasable assembly means for attaching the front badge plate to the fastener is a pair of matched first and second panels, the first panel being the first panel attached to the fastener, and the second panel being attached to the badge plate, wherein the first and second panels have matched raised portions and recessed portions sized and positioned for interlocking engagement of the first panel and the second panel.

5. The badge system of claim 4 wherein said first panel and said second panel are provided with means for releasing said panels after engagement.

6. The badge system of claim 5 wherein said releasing means are opposed concave and convex end portions of said first panel and said second panel.

7. The badge system of claim 1 and further comprising means for orienting said second panel on said first panel during assembly of said badge.

8. The badge system of claim 7 wherein said orienting means are protrusions located on the front surface of said first panel and a rear surface of said second panel at the convex ends thereof.

9. A badge for attaching to clothing and other objects, comprising:

(a) a front badge plate having front and rear surfaces, the front surface for bearing identifying information and the rear surface being adapted for selectively removable connection to one of a plurality of interchangeable first panels;

(b) a plurality of first panels each having a front surface and a rear surface, the front surface of each of the first panels being adapted for selectively removable connection to the rear surface of the front badge plate and the rear surface of each of the first panels providing a site for mounting any of a number of types of fasteners for fastening the badge to clothing and other objects;

(c) a fastener mounted on the rear surface of each of the first panels;

whereby each of the first panels may be attached to the front badge plate and selectively removed therefrom in order to replace it with another of the first panels having a different fastener attached thereto, and further comprising a releasable assembly means for attaching the front badge plate to one of the first panels, the releasable assembly means being selected from the group consisting of contact adhesives, snaps, magnets, loop and hook fabric layer fasteners, releasable adhesive backed flexible fasteners, tongue and groove fasteners, channel assemblies and a combination of corresponding releasably engagable raised and recessed portions which are formed on the front surface of the first panel and the rear surface of the front badge plate, wherein the fastener is selected from the group consisting of a clip, a pair of military style pins, a magnet in conjunction with a metal plate, a horizontal pin, an alligator clip and a contact adhesive, wherein the releasable assembly means for attaching the front badge plate to the fastener is a pair of matched first and second panels, the first panel being the first panel attached to the fastener, and the second panel being attached to the badge plate, wherein the first and second panels have matched raised portions and recessed portions sized and positioned for interlocking engagement of the first panel and the second panel, wherein said first panel and said second panel are provided with means for releasing said panels after engagement, and further wherein said releasing means are opposed concave and convex end portions of said first panel and said second panel.

* * * * *